US008424181B2

(12) United States Patent
Lewis et al.

(10) Patent No.: US 8,424,181 B2
(45) Date of Patent: Apr. 23, 2013

(54) HIGH PRESSURE REVAMP OF LOW PRESSURE DISTILLATE HYDROTREATING PROCESS UNITS

(75) Inventors: William Ernest Lewis, Baton Rouge, LA (US); William M. Gregory, Matamoras, PA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 333 days.

(21) Appl. No.: 12/798,973

(22) Filed: Apr. 15, 2010

(65) Prior Publication Data

US 2010/0263185 A1 Oct. 21, 2010

Related U.S. Application Data

(60) Provisional application No. 61/212,905, filed on Apr. 17, 2009.

(51) Int. Cl.

| | |
|---|---|
| ***C10G 45/00*** | (2006.01) |
| ***C10G 65/00*** | (2006.01) |
| ***C10G 45/02*** | (2006.01) |
| ***C10G 45/04*** | (2006.01) |

(52) U.S. Cl.
USPC ..... 29/401.1; 29/888.021

(58) Field of Classification Search ..... 29/401.1, 29/888.021
See application file for complete search history.

(56) References Cited

U.S. PATENT DOCUMENTS

| | | | | |
|---|---|---|---|---|
| 4,543,177 | A * | 9/1985 | Murthy et al. | 208/130 |
| 5,114,562 | A * | 5/1992 | Haun et al. | 208/89 |
| 5,925,234 | A * | 7/1999 | Morel et al. | 208/96 |
| 6,096,191 | A * | 8/2000 | Kalnes | 208/105 |
| 6,797,154 | B2 * | 9/2004 | Mukherjee et al. | 208/58 |
| 6,843,906 | B1 * | 1/2005 | Eng | 208/210 |
| 7,384,540 | B2 * | 6/2008 | Galeazzi | 208/210 |
| 7,575,670 | B1 * | 8/2009 | VanWees | 208/212 |
| 7,622,034 | B1 * | 11/2009 | Thakkar et al. | 208/210 |
| 8,114,273 | B2 * | 2/2012 | Touffait et al. | 208/210 |
| 2004/0238409 | A1 * | 12/2004 | Virdi et al. | 208/210 |
| 2009/0062566 | A1 * | 3/2009 | Kojima | 564/67 |
| 2011/0315600 | A1 * | 12/2011 | Choi et al. | 208/85 |

OTHER PUBLICATIONS

A.A. Gaile, G.D. Zalishchevskii, V.E. Somov, E.A. Kaifadzhyan and L.L. Koldobskaya, "Principles for Selection of Extraction Systems and Combined Processes for Separation and Treatment of Petroleum Products", Chemistry and Technology of Fuels and Oils, vol. 43, No. 3, May 1, 2007, pp. 186-190, XP019524576, ISSN 1573-8310.

* cited by examiner

*Primary Examiner* — Peter DungBa Vo
*Assistant Examiner* — Anthony Green
(74) *Attorney, Agent, or Firm* — David M. Weisberg; Bruce M. Bordelon

(57) ABSTRACT

A cost effective method for revamping a low pressure distillate hydrotreating process unit to a high pressure distillate hydrotreating process unit. A high pressure hot-feed pump is added, the furnace is retubed for higher pressures, the low pressure reactor is replaced with a high pressure reactor, a high pressure let-down valve is added at the reactor outlet, and the low pressure recycle compressor is replaced with a high pressure recycle compressor.

8 Claims, 1 Drawing Sheet

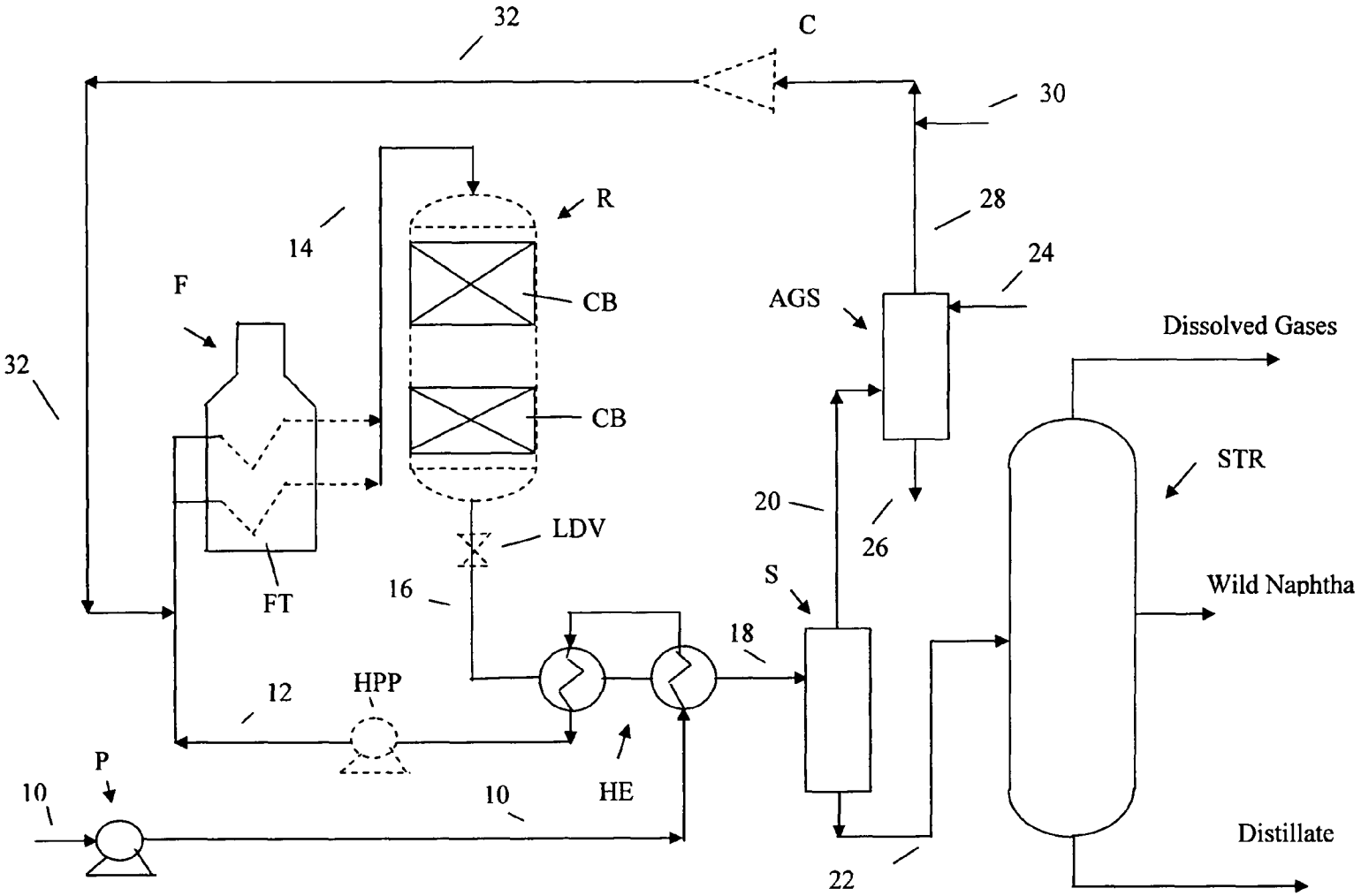
Dissolved Gases
STR
Wild Naphtha
Distillate
30
28
24
26
22
C
AGS
20
S
18
R
CB
CB
LDV
HE
32
10
16
HPP
14
FT
12
F
P
10
32

HIGH PRESSURE REVAMP OF LOW PRESSURE DISTILLATE HYDROTREATING PROCESS UNITS

This Application claims the benefit of U.S. Provisional Application 61/212,905, filed Apr. 17, 2009.

FIELD OF THE INVENTION

The present invention relates to a cost effective method for revamping a low pressure distillate hydrotreating process unit to a high pressure distillate hydrotreating process unit. A high pressure hot-feed pump is added, the furnace is retubed for higher pressures, the low pressure reactor is replaced with a high pressure reactor, a high pressure let-down valve is added at the reactor outlet, and the low pressure recycle compressor is replaced with a high pressure recycle compressor.

BACKGROUND OF THE INVENTION

Impurities such as sulfur in diesel fuels require removal, typically by hydrotreating, in order to comply with product specifications and to ensure compliance with environmental regulations. For example, beginning with the 2007 model year, pollution from heavy-duty highway vehicles was required to be reduced by more than 90 percent. Sulfur in diesel fuel was required to be lowered to enable modern pollution-control technology to be effective on such heavy-duty highway vehicles as trucks and buses. The United States Environmental Protection Agency required a 97 percent reduction in the sulfur content of highway diesel fuel from a level of 500 ppm (low sulfur diesel, or LSD) to 15 ppm (ultra-low sulfur diesel, or ULSD). These new regulations required engine manufactures to meet the 2007 emission standards and to have the flexibility of meeting the new standards through a phase-in approach between 2007 and 2010. These standards are comparable to those in most industrialized nations.

Some of the processes presently in commercial use for producing diesel fuels will not be capable of sufficiently reducing the sulfur content to the new required levels without modifications of some existing hydrotreating processes and equipment. Hydrotreating is an established refinery process for improving the qualities of various petroleum streams from naphtha boiling range streams to heavy oil boiling range streams. Hydrotreating is used to remove contaminants, such as sulfur, nitrogen and metals, as well as to saturate olefins and aromatics to produce a relatively clean product stream for downstream product sales.

Diesel fuels are typically hydrotreated by passing the feed over a hydrotreating catalyst at elevated temperatures and pressures in a hydrogen-containing atmosphere. One suitable family of catalysts that has been widely used for this service is a combination of a Group VIII metal and a Group VI metal of the Periodic Table, such as cobalt and molybdenum, on a support such as alumina. After hydrotreating, the resulting product stream is typically sent to separator to separate hydrogen sulfide and light gases from the treated stream. The resulting hydrotreated stream can then be sent to a stripper to produce two or more desired fractions, such as a diesel fuel fraction and a wild naphtha fraction.

A substantial portion of the diesel pool must now have to comprise ultra-low sulfur diesel. This is putting a great deal of pressure on refiners to find ways to meet the growing demand for such ultra low sulfur feedstocks. Low pressure distillate hydrotreating process unit have been used for many years for removing sulfur from distillate feeds. Low pressure distillate hydrotreating units were the norm until recently because they were able to meet the sulfur requirements at the time. As sulfur requirements became more and more stringent, higher pressure units were needed. In many instances, grass root high pressure distillate hydrotreating process units were built and in other instances older lower pressure units were totally dismantled and replaced with new higher pressure units. Completely replacing a lower pressure hydrotreating process unit with a higher pressure unit, or building a grass roots unit, is very expensive. Therefore, there is a need in the art for ways to revamp existing lower pressure hydrotreating units to higher pressure hydrotreating units at substantially less cost than completely scraping the lower pressure units and replacing it with grass roots high pressure units.

SUMMARY OF THE INVENTION

In accordance with the present invention, there is provided a method for converting a low pressure distillate hydrotreating process unit to a high pressure distillate hydrotreating process unit, which low pressure process unit comprises:

i) a pump for introducing a distillate feedstream to the hydrotreating process unit;

ii) a heat exchanger comprised of a first passageway contiguous to but not in fluid communication with a second passageway, wherein said first passageway is in fluid communication with said pump;

iii) a furnace containing tubes having a first end and a second end and designed for pressures up to about 500 psig and through which distillate feedstream can flow, which tubes have an effective surface area to heat the feedstream to a predetermined reaction temperature and wherein the first end of said tubes is in fluid communication with said first passageway of said heat exchanger and the second end of said tubes is in fluid communication with the inlet of reactor of c) below;

iv) a reactor designed for operating pressures not exceeding about 500 psig and which reactor has an inlet in fluid communication with the second end of said tubes of said furnace and an outlet for removing product, which outlet is in fluid with said second passageway of said heat exchanger;

v) a separator vessel having an inlet in fluid communication with said second passageway of said heat exchanger, said separator having a first outlet for removing vapor phase components and a second outlet for removing a liquid phase product stream;

vi) a stripper in fluid communication with said second outlet of said separator vessel; and vii) a compressor having an inlet and an outlet and wherein said inlet is in fluid communication with the first outlet of said separator vessel and wherein said outlet of said compressor is in fluid communication with the first end of said furnace tubes, which compressor is capable of an outlet pressure of up to about 500 psig;

which method comprising:

a) installing a high pressure pump between said heat exchanger and said furnace, which pump is capable of pumping a liquid feed to a pressure up to about 1,500 psig;

b) replacing the furnace tubes with tubes that can withstand pressures up to about 1,500 psig;

c) replacing said reactor with a reactor designed for pressures up to about 1,500 psig;

d) installing a high pressure letdown valve at the outlet of the reactor capable of reducing the pressure of a feedstream from a pressure of about 1,500 psig to a pressure less than about 500 psig; and e) replacing the recycle compressor with a high pressure compressor capable of compressing a vapor stream to a pressure up to about 1,500 psig.

BRIEF DESCRIPTION OF THE FIGURE

The FIGURE hereof is a schematic representation of a preferred conventional low pressure distillate hydrotreating process unit that has been revamped to a high pressure unit. The components shown in dashed lines are the components that have been replaced or added to covert the unit to a high pressure unit. Other variants of this flow schematic are also within the scope of this invention, for example ones that would show an additional heat exchanger, a make-up hydrogen compressor, a high pressure compressor in series with a low pressure compressor, or an additional separator or a fractionators with or without a reboiler.

DETAILED DESCRIPTION OF THE INVENTION

The present invention provides a method for revamping, as opposed to completely replacing, a low pressure distillate hydrotreating process unit to run at higher pressures suitable for meeting ultra-low sulfur specifications.

Conventional low pressure distillate hydrotreaters are designed to operate at pressures in the range from about 150 psig to about 500 psig, preferably from about 350 to about 500 psig, more preferably from about 350 to about 450 psig. While such hydrotreaters have met with commercial success before ultra-low sulfur requirements, they are unable to meet the new stringent low sulfur levels. High pressure distillate hydrotreaters that have operating pressures in excess of about 600 psig, preferably from about 600 psig to about 1,500 psig, more preferably from about 600 to about 1,200 psig, and most preferably from about 600 to 1,000 psig are better able to meet the stringent sulfur requirements.

Distillate boiling range streams, particularly diesel fuels require additional deeper desulfurization in order to meet the stricter governmental regulations with respect to ultra low sulfur levels. The diesel boiling range feedstreams are generally described as high boiling hydrocarbon streams of petroleum origin. Such feedstreams will typically have a boiling point from about 350° F. to about 750° F. (about 175° C. to about 400° C.), preferably about 400° F. to about 700° F. (about 205° C. to about 370° C.). Non-limiting examples of such streams include gas oils; catalytic cracking cycle oils, including light cat cycle oil (LCCO) and heavy cat cycle oil (HCCO); clarified slurry oil (CSO); as well as other thermally and catalytically cracked products, such as coker light gas oil, are potential sources of feeds for distillate hydrotreating. If used, it is preferred that cycle oils make up a minor component of the feed. Cycle oils from catalytic and thermal cracking processes typically have a boiling range of about 400° F. to 750° F. (about 205° C. to 400° C.), although light cycle oils may have a lower end point, e.g. 600° F. or 650° F. (about 315° C. or 345° C.). Because of the high content of aromatics found in such cycle oils, as well as undesirable amounts of nitrogen and sulfur, they require more severe process conditions. Lighter feeds may also be used, e.g. those in the boiling range of about 250° F. to about 400° F. (about 120° C. to about 205° C.). The use of lighter feeds will result in the production of higher value, lighter distillate products, such as kerosene.

Distillate boiling range feedstreams that can be used in the practice of the present invention can contain a substantial amount of nitrogen, e.g. from about 10 wppm to about 1000 wppm nitrogen in the form of organic nitrogen compounds. The feedstreams can also contain a significant sulfur content, ranging from about 0.1 wt % to 3 wt %, and higher.

The main components of a low pressure conventional distillate hydrotreating process unit are shown in the FIGURE hereof. These main components are: feed pump P, heat exchanger HE, furnace F, reactor R, separator S, stripper STR, recycle compressor C and optionally an acid gas scrubber AGS. In accordance with the present invention, a conventional low pressure distillate hydrotreating process unit is revamped to a high pressure unit by: a) installing a high pressure pump HPP between heat exchanger HE and furnace F, which pump is capable of pumping a liquid feed to a pressure up to about 1,500 psig; b) replacing the furnace tubes with tubes that can withstand pressures up to about 1,500 psig; c) replacing said reactor with a reactor designed for pressures up to about 1,500 psig; d) installing a high pressure letdown valve LDV at the outlet of the reactor, which valve is capable of reducing the pressure of the treated feedstream from a pressure of about 1,500 psig to less than about 500 psig; and e) replacing the recycle compressor with a high pressure compressor C, or adding a second higher pressure compressor in series with the lower pressure compressor, so that the vapor stream can be compressed to a pressure up to about 1,500 psig. These revamping modifications to an existing low pressure distillate hydrotreating unit are shown by dashed lines in the FIGURE hereof.

During service, a distillate feed is introduced into the system via line 10 and feed pump P where it is passed through heat exchanger HE that can be any suitable heat exchanger for this purpose. The heat exchanger will preferably be a "shell and tube" type of heat exchanger that is well known in the art. Shell and tube heat exchangers are typically comprised of a series of tubes positioned within a shell. A set of these tubes contains the fluid that must be either heated or cooled, in this case the distillate feedstream that will be preheated. The second fluid, the hot product stream from reactor R is introduced in the shell and passes over the tubes and transfers heat to preheat the feedstream. A set of tubes is called the tube bundle and can be made up of several types of tubes: plain, longitudinally finned, etc. For purposes of this disclosure, the "passageway" can be used to describe both the tube bundle or interior of the shell for a shell and tube type of heat exchanger as well as for the other types of heat exchangers. The preheated feedstream is passed via line 12 to furnace F where it flows though furnace tubes FT of sufficient surface area to provide the desired heating of the feedstream before it is passed to reactor R via line 14. One element of the revamp of the present invention is to include a high pressure pump HPP between heat exchanger HE and furnace F. This high pressure pump is able to withstand pressures up to 1,500 psig, preferably up to about 1,200 psig. Furnaces for heating feedstreams to a desired reaction temperature range are well known in the art and any suitable furnace can be used as long as it can heat the distillate feedstream to temperatures of the operating conditions of the reactor, which will typically be from about 260° C. to about 425° C., preferably from about 300° to about 400° C., more preferably from about 345° C. to about 385° C. Since the furnace tubes of low pressure hydrotreating process units are typically designed for pressure of no more than about 500 psig, the furnace tubes will be replaced with furnace tubes able to withstand the high revamp pressures as previously mentioned.

The heated feed will be conducted from furnace F to reactor R, which for purposes of this invention will be replaced with a reactor that is capable of operating at pressures up to about 1,500 psig, preferably up to about 1,200 psig. Reactors used for distillate hydrotreating typically contain one or more fixed beds of catalysts CB. Suitable hydrotreating catalysts for use in the present invention are any conventional hydrodesulfurization catalyst and includes those that are comprised of at least one Group VIII metal, preferably Fe, Co or Ni, more preferably Co and/or Ni, and most preferably Co; and at least one Group VI metal, preferably Mo or W, more preferably Mo, on a relatively high surface area support material, preferably alumina. Other suitable hydrotreating catalyst supports include zeolites, amorphous silica-alumina, and titania-alumina. Noble metal catalysts can also be employed, preferably when the noble metal is selected from Pd and Pt. It is within the scope of the present invention that more than one type of hydrodesulfurization catalyst be used in the same reaction vessel. The Group VIII metal is typically present in an amount ranging from about 2 to 20 wt. %, preferably from about 4 to 12%. The Group VI metal will typically be present in an amount ranging from about 5 to 50 wt. %, preferably from about 10 to 40 wt. %, and more preferably from about 20 to 30 wt. %. All metals weight percents are on support. By "on support" we mean that the percents are based on the weight of the support. For example, if the support were to weigh 100 g. then 20 wt. % Group VIII metal would mean that 20 g. of Group VIII metal was on the support.

Returning now to the FIGURE, hot reaction products from reactor R are partially cooled by flowing via line 16 through high pressure let-down valve LDV wherein the pressure of the product stream is let-down to the pressure of conventional low pressure distillate hydrotreater pressures of about 500 psig or less, preferably to about 150 psig to about 450 psig. Conventional low pressure hydrotreating process units typically do not need pressure let-down valves, thus as part of the revamp of the present invention a suitable pressure let-down valve is installed. High pressure let-down valves are well known in the art and no additional description is needed for purposes of this disclosure. The product stream, now at the lower pressure is conducted through heat exchanger HE where it passes through second passageway to preheat the feedstream passing through the first passageway of heat exchanger HE. The product stream is then sent to separator S via line 18 where a light vapor fraction comprised primarily of unused hydrogen, hydrogen sulfide and other gases are removed overhead via line 20 and a substantially sulfur-free distillate product stream is recovered via line 22. The substantially sulfur-free distillate product stream can be sent to stripper STR where a stripping gas, preferably steam, is used to strip the product stream into predetermined boiling point cuts, preferably a vapor cut, a wild naphtha cut and a distillate product cut. The vapor cut will be comprised of gases that were carried over from the separator as dissolved gases and include gaseous components such as $H_2S$ and light ends. It is within the scope of this invention that a fractionator (not shown) be used to separate the various desired product fractions with or without a reboiler.

The light vapor fraction exits separator S via line 20 and can be passed to acid gas scrubber AGS which, although optional is preferred, to remove acid gases, primarily $H_2S$. Any suitable acid gas treating technology can be used in the practice of the present invention. Also, any suitable scrubbing agent, preferably a basic solution can be used in the acid gas scrubbing zone AGS that will adsorb the desired level of acid gases ($H_2S$) from the vapor stream. One suitable acid gas scrubbing technology is the use of an amine scrubber. Non-limiting examples of such basic solutions are amines, preferably diethanol amine, mono-ethanol amine, and the like. More preferred is diethanol amine. Another preferred acid gas scrubbing technology is the so-called "Rectisol Wash" which uses an organic solvent, typically methanol, at subzero temperatures. The scrubbed stream can also be passed through one or more guard beds (not shown) to remove any trace amounts of catalyst poisoning impurities such as sulfur, halides etc. Amine scrubbing is preferred and a lean amine stream is introduced into acid gas scrubber AGS via line 24 and a rich amine stream is removed from the scrubber via line 26. The rich amine stream will contain absorbed sour gases which can be sent to a hydrogen recovery unit (not shown). After purging a portion to maintain hydrogen purity, a hydrogen-rich gas is passed through high pressure compressor C via line 28 along with make-up hydrogen via line 30 to bring the stream up to the designed pressure of the hydrotreating process unit. The compressed stream is then sent to furnace F via line 32.

What is claimed is:

1. A method for converting a low pressure distillate hydrotreating process unit to a high pressure distillate hydrotreating process unit, which low pressure process unit comprises:

i) a pump for introducing a distillate feedstream to the hydrotreating process unit;

ii) a heat exchanger comprised of a first passageway contiguous to but not in fluid communication with a second passageway, wherein said first passageway is in fluid communication with said pump;

iii) a furnace containing tubes having a first end and a second end and designed for pressures up to about 500 psig and through which distillate feedstream can flow, which tubes have an effective surface area to heat the feedstream to a predetermined reaction temperature and wherein the first end of said tubes is in fluid communication with said first passageway of said heat exchanger and the second end of said tubes is in fluid communication with the inlet of reactor of c) below;

iv) a reactor designed for operating pressures not exceeding about 500 psig and which reactor has an inlet in fluid communication with the second end of said tubes of said furnace and an outlet for removing product, which outlet is in fluid with said second passageway of said heat exchanger;

v) a separator vessel having an inlet in fluid communication with said second passageway of said heat exchanger, said separator having a first outlet for removing vapor phase components and a second outlet for removing a liquid phase product stream;

vi) a stripper in fluid communication with said second outlet of said separator vessel; and vii) a low pressure recycle compressor having an inlet and an outlet and wherein said inlet is in fluid communication with the first outlet of said separator vessel and wherein said outlet of said compressor is in fluid communication with the first end of said furnace tubes, which compressor is capable of an outlet pressure of up to about 500 psig;

which method comprises:

a) installing a high pressure pump between said heat exchanger and said furnace, which pump is capable of pumping a liquid feed to a pressure up to about 1,500 psig;

b) replacing the furnace tubes with tubes that can withstand pressures up to about 1,500 psig;

c) replacing said reactor with a reactor designed for pressures up to about 1,500 psig;

d) installing a high pressure letdown valve at the outlet of the reactor capable of reducing the pressure of a feedstream from a pressure of about 1,500 psig to a pressure less than about 500 psig; and e) replacing the low pressure recycle compressor with a high pressure compressor, or in the alternative adding a high pressure compressor in series with the recycle compressor, which high pressure compressor is capable of compressing a vapor stream to a pressure up to about 1,500 psig.

2. The method of claim 1 wherein the heat exchanger is a shell and tube heat exchanger.

3. The method of claim 1 wherein the high pressure pump is capable of an outlet pressure of up to about 1,200 psig.

4. The method of claim 3 wherein the replacement furnace tubes are capable of withstanding pressures up to about 1,200 psig.

5. The method of claim 4 wherein the reactor is capable of withstanding pressures up to about 1,200 psig.

6. The method of claim 5 wherein the high pressure compressor is capable of an outlet pressure of up to about 1,200 psig.

7. The method of claim 1 wherein the high pressure compressor is placed in series and downstream of the low pressure recycle compressor.

8. The method of claim 1 wherein the high pressure compressor replaces the low pressure recycle compressor.

* * * * *